US009999246B2

(12) United States Patent
Suzuki et al.

(10) Patent No.: US 9,999,246 B2
(45) Date of Patent: Jun. 19, 2018

(54) NON-BURNING TYPE FLAVOR INHALER

(71) Applicant: JAPAN TOBACCO INC., Tokyo (JP)

(72) Inventors: Akihiko Suzuki, Tokyo (JP); Kimitaka Uchii, Tokyo (JP); Takashi Hasegawa, Tokyo (JP); Manabu Yamada, Tokyo (JP); Manabu Takeuchi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 102 days.

(21) Appl. No.: 14/845,945

(22) Filed: Sep. 4, 2015

(65) Prior Publication Data

US 2015/0374036 A1 Dec. 31, 2015

Related U.S. Application Data

(63) Continuation of application No. PCT/JP2014/055764, filed on Mar. 6, 2014.

(30) Foreign Application Priority Data

Mar. 8, 2013 (JP) ..... 2013-047285
Mar. 8, 2013 (JP) ..... 2013-047286

(51) Int. Cl.
*A24F 47/00* (2006.01)
*A24B 15/16* (2006.01)

(52) U.S. Cl.
CPC ..... *A24F 47/002* (2013.01); *A24B 15/165* (2013.01); *A24F 47/006* (2013.01); *A24F 47/008* (2013.01)

(58) Field of Classification Search
None
See application file for complete search history.

(56) References Cited

U.S. PATENT DOCUMENTS 9,046,278 B2 6/2015 Köller
2005/0236006 A1* 10/2005 Cowan ..... A24F 47/004 131/270
2008/0000489 A1 1/2008 Suovaniemie et al.
2010/0059070 A1* 3/2010 Potter ..... A24F 47/004 131/194
2011/0290266 A1 12/2011 Köller
2012/0298123 A1* 11/2012 Woodcock ..... A24B 15/165 131/328

FOREIGN PATENT DOCUMENTS

JP 2008-515859 A 5/2008
JP 2011-525366 A 9/2011

OTHER PUBLICATIONS

International Search Report, issued in PCT/JP2014/055764, dated Jun. 3, 2014.
European Office Action, dated Jun. 16, 2017, for European Application No. 14760671.9.

* cited by examiner

*Primary Examiner* — Michael H Wilson
*Assistant Examiner* — Katherine Will
(74) *Attorney, Agent, or Firm* — Birch, Stewart, Kolasch & Birch, LLP

(57) ABSTRACT

A non-combustion-type flavor inhaler containing a heat source and a holding member for detachably holding the heat source. The heat source includes a latent heat storage material containing a sugar alcohol of four or more carbons atoms.

10 Claims, 10 Drawing Sheets

NON-BURNING TYPE FLAVOR INHALER

CROSS REFERENCE TO RELATED APPLICATIONS

This application is a Continuation of PCT International Application No. PCT/JP2014/055764 filed on Mar. 6, 2014, which claims priority under 35 U.S.C. § 119(a) to Patent Application Nos. 2013-047285 and 2013-047286 filed in Japan on Mar. 8, 2013, all of which are hereby expressly incorporated by reference into the present application.

TECHNICAL FIELD

The present invention relates to a non-burning type flavor inhaler including a heat source and a cylindrical member.

BACKGROUND ART

Conventionally, a non-burning type flavor inhaler including a heat source having a columnar shape, and a cylindrical member having a cylindrical shape is known. For example, one end of the cylindrical member configures a mouthpiece, and the other end of the cylindrical member configures a support portion that supports the heat source. The heat source includes a latent heat storage material that makes use of latent heat (also called as the heat of fusion or the heat of crystallization) (for example, see Patent Literature 1).

Here, sodium acetate trihydrate, sodium sulfate decahydrate, and magnesium nitrate hexahydrate are used as the latent heat storage material described above.

However, the latent heat storage material such as sodium acetate produces bad smells and loses the flavor when it is heated up to approximately the fusion point.

CITATION LIST

Patent Literature

Patent Literature 1: Japanese Patent Publication No. 2011-525366

SUMMARY OF INVENTION

A non-burning type flavor inhaler according to a first feature includes: a heat source that supplies heat energy to a flavor source; and a holding member that detachably holds the heat source. The heat source has a latent heat storage material including a sugar alcohol having a carbon number of four or more.

In the first feature, the heat source includes a mixture of the latent heat storage material and a retaining material that retains the latent heat storage material.

In the first feature, a content of the latent heat storage material is 300 mg or more, and 600 mg or less.

In the first feature, the retaining material is vermiculite.

In the first feature, a content of vermiculite is 100 wt % or more and 200 wt % or less with respect to the latent heat storage material.

A heating apparatus according to a second feature heats the heat source configured to be detachable from a holding member provided in the non-burning type flavor inhaler. The heating apparatus includes a storage portion that stores the heat source, a heating portion that heats the heat source, and a locking mechanism that locks the heat source inside the storage portion until the temperature of the heat source exceeds a predetermined temperature. The locking mechanism unlocks the locked status of the heat source when the temperature of the heat source exceeds the predetermined temperature. The heating portion stops heating the heat source when the temperature of the heat source exceeds the predetermined temperature.

In the second feature, the locking mechanism includes a bi-metal that is arranged so as to contact with the heat source. The bi-metal is deformed with the predetermined temperature as the limit. The locking mechanism unlocks the locked state of the heat source as a result of the deformation of the bi-metal that occurs when the temperature of the heat source exceeds the predetermined temperature.

In the second feature, the locking mechanism includes a holding member that holds the side walls of the heat source in response to the insertion of the heat source in the storage portion. The holding member releases the holding state of the side walls of the heat source by the holding member as a result of the deformation of the bi-metal that occurs when the temperature of the heat source exceeds the predetermined temperature.

In the second feature, the storage portion has a bottom surface and an inner wall surface that rises up from the bottom surface. In the state where the heat source is stored in the storage portion, the end of the heat source positioned on the opposite side of the bottom surface is separated from the inner wall surface.

In the second feature, there is included a sliding mechanism for sliding the heat source along the inner wall surface when the locked state of the heat source is unlocked.

In the second feature, the sliding mechanism includes a bi-metal that is arranged so as to contact with the heat source. The bi-metal is deformed with the predetermined temperature as the limit. The sliding mechanism slides the heat source along the inner wall surface as a result of the deformation of the bi-metal that occurs when the temperature of the heat source exceeds the predetermined temperature.

In the second feature, the heating apparatus includes a pair of electrodes for supplying power to the heating portion. The sliding mechanism separates the pair of electrodes as a result of the deformation of the bi-metal that occurs when the temperature of the heat source exceeds the predetermined temperature.

In the second feature, the heat source has a groove portion in which the holding member is engaged.

A heating method according to a second feature is a method for heating a heat source by a heating apparatus, the heat source being configured to be detachable from a holding member provided in a non-burning type flavor inhaler. The heating method includes a step of locking the heat source in a storage portion of the heating apparatus until the heat source exceeds a predetermined temperature in the heating apparatus, a step of heating the heat source in the heating apparatus, a step of unlocking the heat source when the heat source exceeds the predetermined temperature in the heating apparatus, and a step of stopping the heating of the heat source by the heating apparatus when the heat source exceeds the predetermined temperature in the heating apparatus.

DESCRIPTION OF EMBODIMENTS

Figure 1:
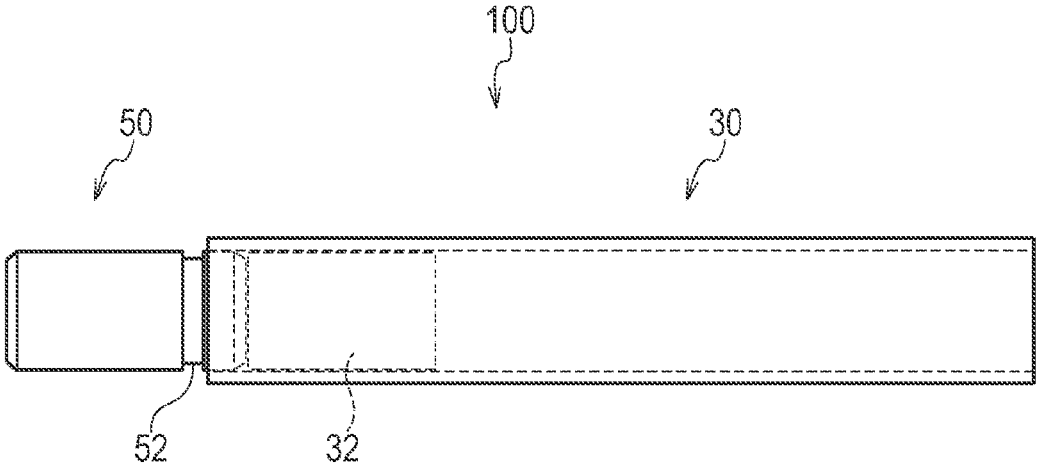
FIG. 1 is a drawing showing a non-burning type flavor inhaler 100 according to a first embodiment.

Hereinafter, embodiments of the present invention will be described with reference to the drawings. In the following drawings, identical or similar components are denoted by identical or similar reference numerals. Note that the drawings are schematic and the ratio of dimensions are different from actual ones.

Therefore, specific dimensions should be determined with reference to the description below. It is needless to mention that different relationships and ratio of dimensions may be included in different drawings.

Overview of Embodiments

A non-burning type flavor inhaler according to the embodiments includes: a heat source that supplies heat energy to a flavor source; and a holding member that detachably holds the heat source. The heat source has a latent heat storage material including a sugar alcohol having a carbon number of four or more.

In the embodiments, the heat source separated from the holding member includes the sugar alcohol having the carbon number of four or more as the latent heat storage material.

Since the sugar alcohol having the carbon number of four or more has a comparatively high fusion point as compared to sodium acetate, it is possible to realize relatively high latent heat. Therefore, it is possible to more effectively supply the heat to the flavor source than until now. In addition, a sugar alcohol having a carbon number of four or more has a low volatility, and no smell is generated even upon evaporation. Therefore, as compared to a latent heat storage material, such as sodium acetate, since almost no smell is generated even after heating up to the fusion point, it is possible to improve the flavor without losing the flavor.

In the embodiments, the latent heat storage material is the sugar alcohol having the carbon number of four or more, and therefore, it is possible to obtain a comparatively high latent heat (also called as the heat of fusion or the heat of crystallization). Therefore, it is possible to transmit a comparatively high temperature from the heat source to the flavor source.

First Embodiment (Non-Burning Type Flavor Inhaler)

Figure 2:
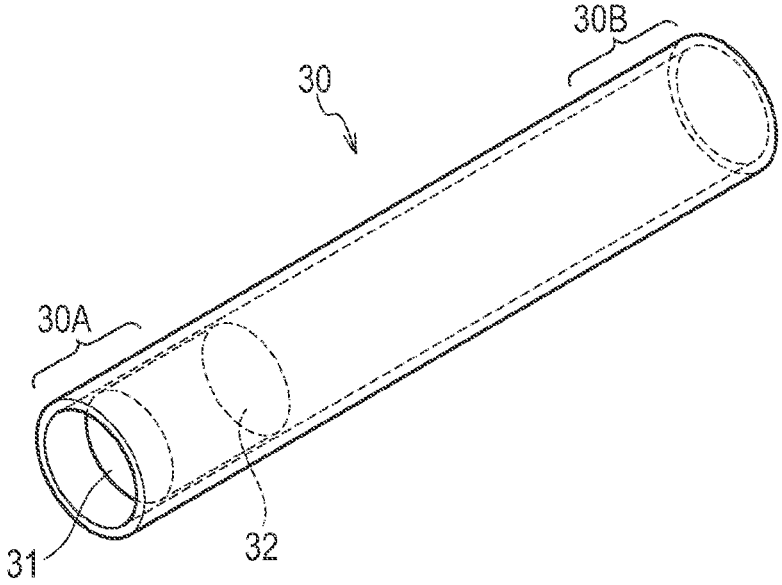
FIG. 2 is a drawing showing a holding member 30 according to the first embodiment.
Figure 3:
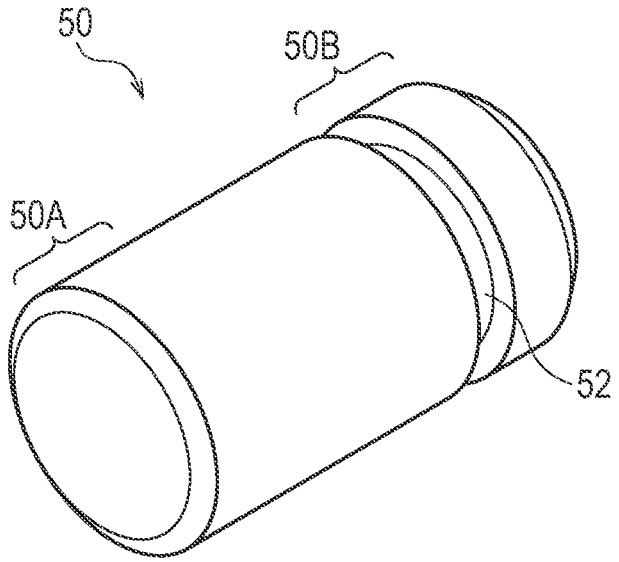
FIG. 3 is a drawing showing a heat source 50 according to the first embodiment.
Figure 4:
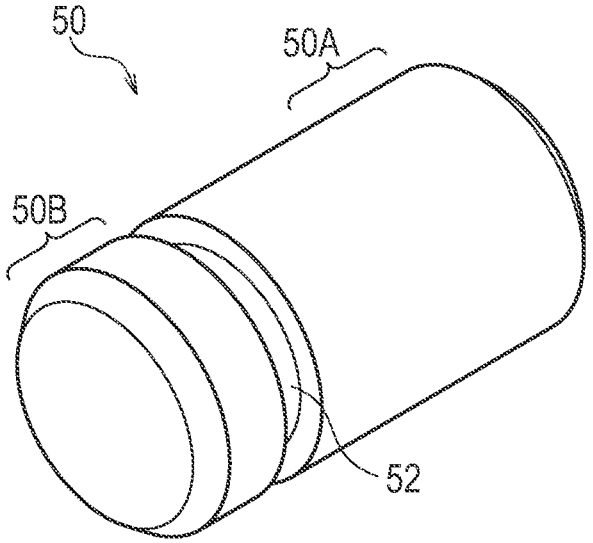
FIG. 4 is a drawing showing a heat source 50 according to the first embodiment.

Hereinafter, a non-burning type flavor inhaler according to a first embodiment will be described. FIG. 1 is a drawing showing a non-burning type flavor inhaler 100 according to the first embodiment. FIG. 2 is a drawing showing a holding member 30. FIG. 3 and FIG. 4 are drawings showing a heat source 50. FIG. 3 is a drawing showing the heat source 50 as seen from the side of the non-insertion end 50A. FIG. 4 is a drawing showing the heat source 50 as seen from the side of the insertion end 50B.

As shown in FIG. 1, the non-burning type flavor inhaler 100 has a holding member 30 and a heat source 50. In the first embodiment, it must be noted that the non-burning type flavor inhaler 100 is a flavor inhaler that does not burn.

As shown in FIG. 2, the holding member 30 detachably holds the heat source 50. The holding member 30 has a supporting end 30A and a mouthpiece-side end 30B. The supporting end 30A is an end that holds the heat source 50. The mouthpiece-side end 30B is an end that is provided at the side of the mouthpiece of the non-burning type flavor inhaler. In the first embodiment, the mouthpiece-side end 30B configures the mouthpiece of the non-burning type flavor inhaler 100. However, the mouthpiece of the non-burning type flavor inhaler 100 may be provided as a separate body from the holding member 30.

The holding member 30 has a cylindrical shape including a cavity 31 extending from the supporting end 30 A along a direction facing the mouthpiece-side end 30B. For example, the holding member 30 has a cylindrical shape or a square tubular shape. The holding member 30 has a flavor source 32 that vaporizes the flavor components through heating by the heat source 50.

It is possible to use granular tobacco leaves used in cigarettes and snuff boxes, for example, as the flavor source 32. It may be also possible to realize the flavor source 32 by filling the above-described granular tobacco leaves in a pouch made of a nonwoven cloth or the like that has air permeability. Moreover, the flavor source 32 may be realized by laminating a member having air permeability, such as a nonwoven cloth and granular tobacco leaves to form the flavor source 32 in the shape of a sheet through thermal fusion bonding, or the flavor source 32 may be formed in other desired shapes. Moreover, it is possible to use, as the flavor source 32, a support made of a porous material, such as activated carbon, or a non-porous material that supports various flavor components, such as menthol.

In the first embodiment, although the holding member 30 having the cylindrical shape is illustrated, the embodiment is not limited thereto. That is, the holding member 30 may have a configuration for holding the heat source 50.

As shown in FIG. 3 and FIG. 4, the heat source 50 has a non-insertion end 50A and an insertion end 50B. The non-insertion end 50A is the end that is exposed from the holding member 30 in the state where the heat source 50 is inserted in the holding member 30. The insertion end 50B is the end that is inserted in the holding member 30.

The heat source 50 includes a latent heat storage material that generates heat through latent heat (also called as the heat of fusion or the heat of crystallization). By including a latent heat storage material, the latent heat storage material is capable of accumulating the heat from the heating source upon being heated. Thereafter, the latent heat storage material is capable of supplying the accumulated heat energy to the heat source, and upon receiving the heat energy, the heat source is capable of effectively releasing the flavor. The heat source 50 includes a sugar alcohol having a carbon number of four or more as the latent heat storage material. As described earlier, as compared to a latent heat storage material, such as sodium acetate, since a sugar alcohol generates almost no smell even after being heated up to the fusion point, it is possible to favorably adopt the sugar alcohol as the heat source of a flavor inhaler.

Here, the latent heat storage material is preferably configured by one or more types of substances selected from erythritol, glycerol, D-mannitol, L-mannitol, DL-mannitol, sorbitol, xylitol, threitol, D-arabinitol, L-arabinitol, DL-arabinitol, ribitol, D-iditol, L-iditol, dulcitol, volemitol, perseitol, inositol, (+)-prot0-quercitol, (−)-vibo-quercitol, pentaerythritol, di-pentaerythritol, allitol, D-talitol, L-talitol, and DL-talitol. In the present invention, it is preferable to use at least erythritol or mannitol as the latent heat storage material, and it is particularly preferable to use at least erythritol as the latent heat storage material.

Erythritol is extremely favorable when granular tobacco leaves are used as the flavor source. Specifically, when erythritol is used as the latent heat storage material, it is possible to effectively volatilize the flavor components in the tobacco leaves, and at the same time, it is possible to keep the volatilization volume of the flavor components in the tobacco leaves in a stable manner and over a long period of time.

The content of the latent heat storage material is preferably 300 mg or more, and 600 mg or less. When the content of the latent heat storage material is 300 mg or more, the temperature at which a sufficient amount of flavor components is volatilized is maintained for more than a fixed period of time. When the content of the latent heat storage material is 600 mg or less, the increase in the size of the heat source 50 is controlled.

In the first embodiment, the heat source 50 preferably includes a mixture of the latent heat storage material and a retaining material that retains the latent heat storage material. Specifically, the retaining material is preferably a material capable of retaining the latent heat storage material inside the heat source 50 even when the latent heat storage material reaches the fusion point and liquefies. In the present invention, the retaining material that configures the heat source 50 is preferably a compound having a multi-layer structure, and vermiculite is particularly preferable as the compound having a multi-layer structure.

By using vermiculite as the retaining material, the excessive heat release per unit time to the outside of the heat source 50 is controlled, and at the same time, the heat is released slowly. As a result, the temperature at which a sufficient amount of flavor components is volatilized is maintained for more than a fixed period of time.

Moreover, when vermiculite is used as the retaining material, the content of the retaining material is preferably 100 wt % or more and 200 wt % or less with respect to the latent heat storage material.

When the weight percent of vermiculite with respect to the latent heat storage material is 100% or more, the retaining material is capable of retaining a sufficient amount of the latent heat storage material, because of which even when the latent heat storage material is heated and liquefies, the outflow of the latent heat storage material from the heat source 50 is controlled. When the weight percent of vermiculite with respect to the latent heat storage material is 200% or less, it is possible to prevent the excessive displacement of the amount of heat released by the latent heat storage material upon liquefaction by vermiculite.

In addition to the latent heat storage material and the retaining material, the heat source 50 preferably further includes a binder from the viewpoint of formability of the heat source 50. The binder is not particularly limited, and it is possible to favorably use any well-known binder; however, it is particularly favorably use hydroxypropyl cellulose.

The method of manufacturing the heat source 50 is not particularly limited, and it is possible to favorably use any well-known manufacturing method; however, manufacturing the heat source 50 through tableting or extrusion is more favorable since it enables an easy configuration of the heat source 50. By using the above-mentioned tableting or extrusion process, it is possible to configure the heat source 50 without using an airtight container having pressure resistance, which enables a reduction in the size and weight of the heat source 50. The heat source 50 may include another material as long as the effect of the present invention is not disturbed.

Moreover, the outer circumference of the heat source 50 configured by the above-described tableting or extrusion process may be covered by a heat conducting member, such as the so-called aluminum metal foil. This makes it possible to heat the heat source 50 in a short period of time.

In the first embodiment, the heat source 50 is heated until the latent heat storage material fuses, by using a heating apparatus provided separately from the non-burning type flavor inhaler 100. This makes it possible to use the latent heat of the latent heat storage material.

Here, by heating the heat source 50 using a heating apparatus provided separately from the non-burning type flavor inhaler 100, and then removing the heated heat source 50 from the heating apparatus and mounting it on the holding member 30, it is possible to transmit the heat energy retained in the heat source 50 to the flavor source 32.

In the first embodiment, the non-burning type flavor inhaler 100 and the heating apparatus may also be provided as an integrated body, however, from the viewpoint of the size reduction of the non-burning type flavor inhaler 100 and portability of the non-burning type flavor inhaler 100, the non-burning type flavor inhaler 100 and the heating apparatus are preferably formed as separate bodies.

In the first embodiment, the heat source 50 includes a groove portion 52. The groove portion 52 is provided along the outer circumference of the heat source 50, and is the site where the locking mechanism of the heating apparatus is engaged when the heat source 50 is heated by the heating apparatus described later.

(Heating Apparatus)

Figure 5:
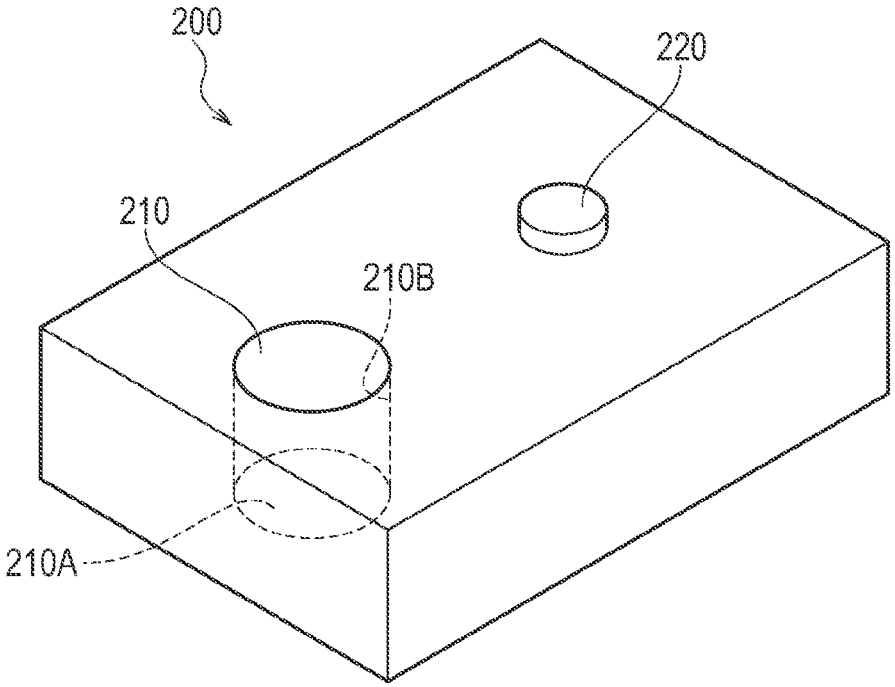
FIG. 5 is a drawing showing a heating apparatus 200 according to the first embodiment.
Figure 6:
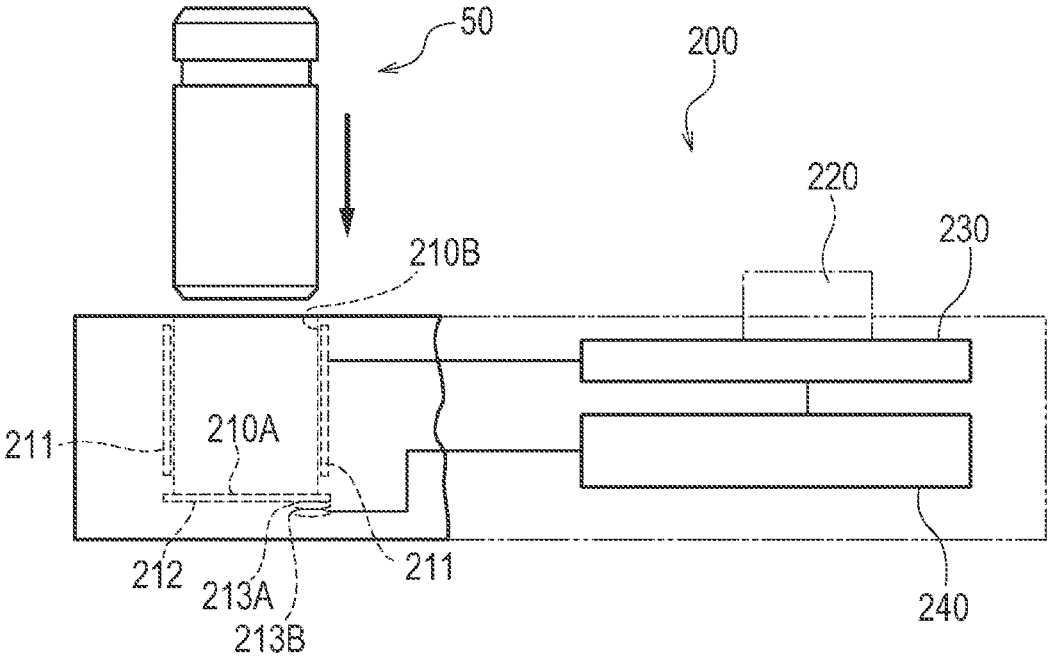
FIG. 6 is a drawing showing a heating apparatus 200 according to the first embodiment.
Figure 7:
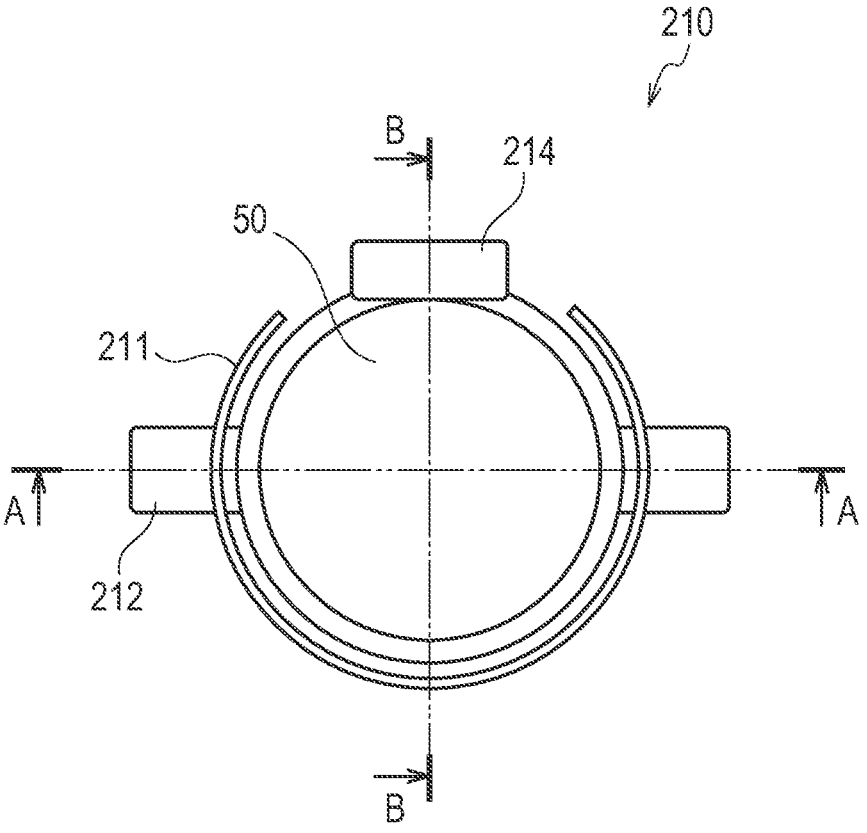
FIG. 7 is a drawing showing a storage portion 210 according to the first embodiment.

Hereinafter, the heating apparatus according to the first embodiment will be described. FIG. 5 through FIG. 7 are drawings showing a heating apparatus 200 according to the first embodiment. FIG. 5 is a perspective view showing the heating apparatus 200. FIG. 6 is a drawing showing a side view of the heating apparatus 200. FIG. 7 is a top view of a storage portion 210.

As shown in FIG. 5 and FIG. 6, the heating apparatus 200 includes the storage portion 210, a switch 220, a circuit board 230, and a battery 240.

The storage portion 210 stores the heat source 50. Specifically, the storage portion 210 includes a bottom surface 210A and an inner wall surface 210B that rises up from the bottom surface 210A. The bottom surface 210A and the inner wall surface 210B configure a cavity for storing the heat source 50. The cavity that is configured by the bottom surface 210A and the inner wall surface 210B has approximately the same shape as the non-insertion end 50A of the heat source 50. In the state where the heat source 50 is stored in the storage portion 210, the non-insertion end 50A of the heat source 50 is arranged on the bottom surface 210A.

Here, in the state where the heat source 50 is stored in the storage portion 210, the end of the heat source 50 that is positioned on the opposite side of the bottom surface 210A (that is, the insertion end 50B) is preferably separated from the inner wall surface 210B. In the first embodiment, as shown in FIG. 6, the length of the inner wall surface 210B in a vertical direction with respect to the bottom surface 210A is shorter than the length of the heat source 50 from the non-insertion end 50A toward the insertion end 50B. That is, in the state where the heat source 50 is stored in the storage portion 210, the insertion end 50B of the heat source 50 is exposed from the inner wall surface 210B. Thus, the insertion end 50B is separated from the inner wall surface 210B, and thus, it is easy to install the heat source 50 stored in the storage portion 210, on the holding member 30.

Moreover, the insertion end 50B has a shape wherein the outer shape of the insertion end 50B is small toward the front end of the insertion end 50B. This makes it easy to insert the heat source 50 that is stored in the storage portion 210 into the holding member 30.

Note that the outer diameter of the insertion end 50B of the heat source 50 may be smaller than the inner diameter of the storage portion 210. Thus, even if the length of the inner wall surface 210B in the vertical direction with respect to the bottom surface 210A is more than the length of the heat source 50 from the non-insertion end 50A toward the insertion end 50B, the insertion end 50B is separated from the inner wall surface 210B. Here, the distance of separation of the insertion end 50B from the inner wall surface 210B is preferably equal to or more than the thickness of the holding member 30 (difference between the outer diameter and the inner diameter).

As shown in FIG. 6 and FIG. 7, the heating apparatus 200 includes a heating portion 211, a bi-metal 212, a contact point 213 (contact point 213A and contact point 213B), and a holding spring 214.

The heating portion 211 is configured by a heater, such as an electrically-heated wire. In the first embodiment, the heating portion 211 is arranged along the inner wall surface 210B of the storage portion 210.

The bi-metal 212 is configured by two or more types of metals having different coefficients of thermal expansion. Since it is known that it is possible to appropriately adjust the deformation temperature of the bi-metal 212 on the basis of the metal composition ratio, in the present invention, the bi-metal 212 is configured to be deformed by assuming a predetermined temperature, that is, the fusion point of the latent heat storage material as the limit. In the first embodiment, the bi-metal 212 is arranged on the bottom surface 210A of the storage portion 210 so as to be in direct contact with the heat source 50. When the temperature of the heat source 50 exceeds the predetermined temperature, the bi-metal 212 is deformed in an arched shape, facing the heat source 50 in an upward direction. That is, when the temperature of the heat source 50 exceeds the predetermined temperature, the bi-metal 212 configures a sliding mechanism that slides the heat source 50 along the inner wall surface 210B of the storage portion 210. On the other hand, when the temperature of the heat source 50 is below the predetermined temperature, the bi-metal 212 deforms from the arched shape to a flat plate shape.

The contact point 213 is a contact point for switching whether or not to supply the electric power of the battery 240 to the heating portion 211. Specifically, if the contact point 213A and the contact point 213B are in contact, the electric power of the battery 240 is supplied to the heating portion 211. On the other hand, if the contact point 213A and the contact point 213B are not in contact, the electric power of the battery 240 is not supplied to the heating portion 211.

In the first embodiment, the contact point 213A is bonded to the bi-metal 212. When the bi-metal 212 is deformed in the arched shape, the contact point 213A separates from the contact point 213 as a result of the deformation of the bi-metal 212. On the other hand, if the bi-metal 212 is in the flat plate shape, the contact point 213 is in contact with the contact point 213B.

In response to the insertion of the heat source 50 in the storage portion 210, the holding spring 214 holds the side wall of the heat source 50 (here, the groove portion 52). As described later, if the bi-metal 212 is deformed in the arched shape, the holding spring 214 unlocks the locked state in which the heat source 50 is held.

In the first embodiment, the bi-metal 212 and the holding spring 214 configure a locking mechanism by which the heat source 50 is locked inside the storage portion 210. As described earlier, the bi-metal 212 is arranged so as to contact with the heat source 50, and when the temperature of the heat source 50 exceeds the predetermined temperature, the bi-metal 212 is deformed in the arched shape, facing the heat source 50 in an upward direction. As a result, the locked state where the heat source 50 is held by the holding spring 214 is unlocked. That is, the locking mechanism that is configured by the bi-metal 212 and the holding spring 214 unlocks the locked state of the heat source 50 when the temperature of the heat source 50 exceeds the predetermined temperature.

The switch 220 is a switch for starting the heating of the heat source 50. The switch 220 is connected to the circuit board 230. For example, the heating of the heat source 50 starts when the switch 220 is pressed.

The circuit board 230 includes a control circuit for controlling the heating apparatus 200. For example, upon detecting that the switch 220 has been pressed, the circuit board 230 starts the supply of the electric power of the battery 240 to the heating portion 211.

However, in the first embodiment, if the bimetal 212 is deformed in the arched shape, the contact between the contact point 213A and the contact point 213B is released. Therefore, it must be noted that the circuit board 230 need not control the stopping of the supply of electric power of the battery 240 to the heating portion 211.

Note that when the bi-metal 212 is deformed in the arched shape, the circuit board 230 may stop the supply of electric power of the battery 240 to the heating portion 211 regardless of the contact status of the contact point 213A and the contact point 213B. As a result, the unnecessary reheating of the heat source 50 is controlled.

The battery 240 accumulates the electric power for driving the heating apparatus 200. For example, the electric power accumulated in the battery 240 is supplied to the heating portion 211 and the circuit board 230.

(Locking Mechanism)

Figure 8:
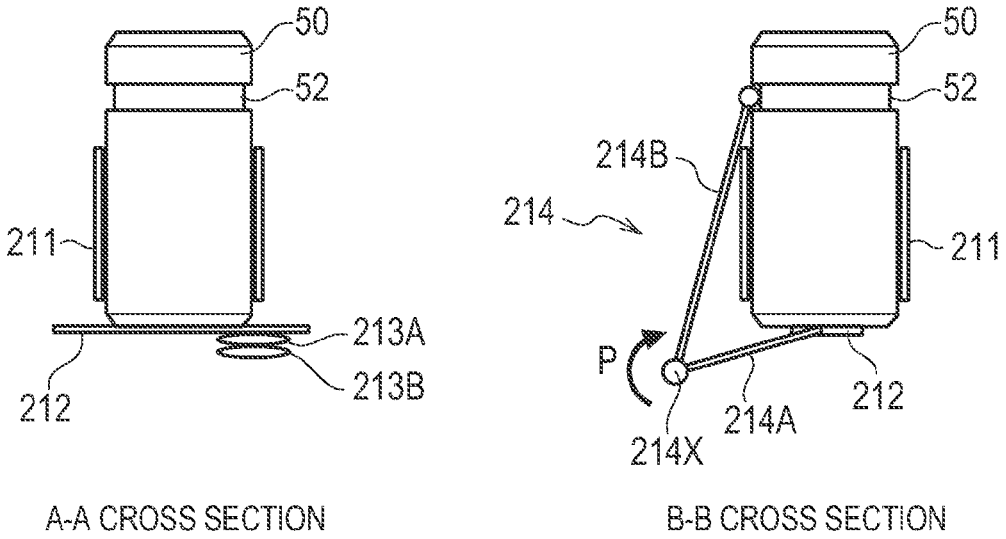
FIG. 8 is a drawing for explaining a locking mechanism according to the first embodiment.
Figure 9:
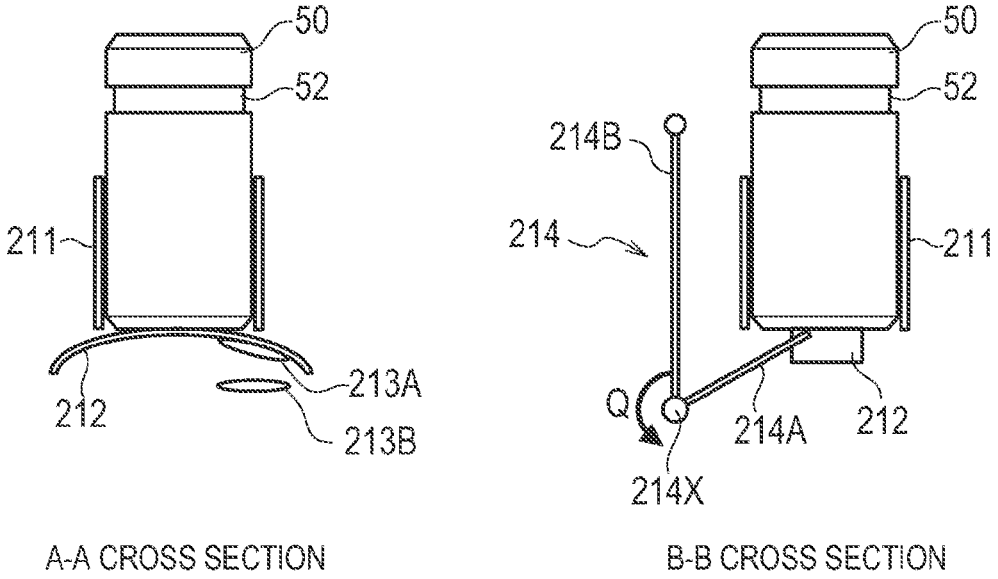
FIG. 9 is a drawing for explaining a locking mechanism according to the first embodiment.
Figure 10:
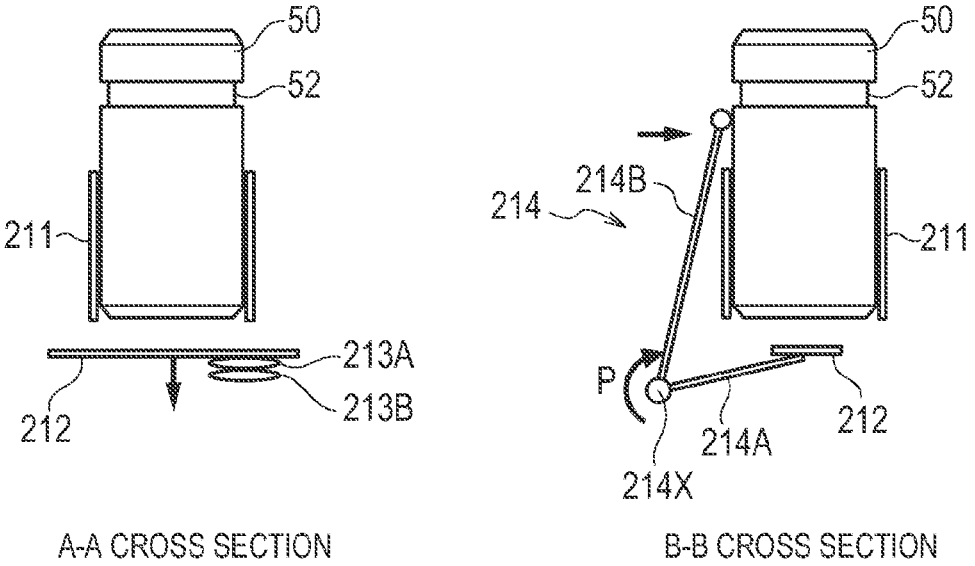
FIG. 10 is a drawing for explaining a locking mechanism according to the first embodiment.

Hereinafter, the locking mechanism according to the first embodiment will be described. FIG. 8 through FIG. 10 are drawings for explaining the locking mechanism according to the first embodiment. In FIG. 8 through FIG. 10, an A-A cross-section and a B-B cross-section of the storage portion 210 shown in FIG. 7 is shown. As described earlier, the locking mechanism for locking the heat source 50 inside the storage portion 210 is configured by the bimetal 212 and the holding spring 214.

As shown in FIG. 8, in the state where the heat source 50 is stored in the storage portion 210, the temperature of the heat source 50 is lower than the predetermined temperature (that is, the fusion point of the latent heat storage material), and therefore, the bi-metal 212 has the flat plate shape. As shown in the cross-section A-A, since the bimetal 212 has the flat plate shape, the contact point 213A and the contact point 213B are in contact. As shown in the cross-section B-B, the bimetal 212 has the flat plate shape, and the heat source 50 that is stored in the storage portion 210 is locked by the holding spring 214.

In particular, the holding spring 214 has an arm 214A and an arm 214B, and the arm 214A and the arm 214B rotate with the point of support 214X as the center. The tip of the arm 214A is mounted on the bimetal 212, and the arm 214B has a biasing force in a direction close to the side surface of the heat source 50 (the P direction), with the point of support 214X as the center. Thus, the tip of the arm 214B is engaged in the groove portion 52, and the heat source 50 is locked inside the storage portion 210. In order to prevent the side surface of the heat source 50 from being damaged, the tip of the arm 214B preferably has a circular shape in the B-B cross-section. The tip of the arm 214B may be spherical in shape.

As shown in FIG. 9, if the heat source 50 is heated by the heating portion 211, and the temperature of the heat source 50 exceeds the predetermined temperature (that is, the fusion point of the latent heat storage material), the bimetal 212 deforms from the flat plate shape to the arched shape, and the heat source 50 slides along the inner wall surface 210B of the storage portion 210. As shown in the A-A cross-section, since the bi-metal 212 is deformed in the arched shape, the contact point 213B separates from the contact point 213A, and the heating of the heat source 50 by the heating portion 211 stops. Here, as described above, the circuit board 230 preferably stops the supply of the electric power of the battery 240 to the heating portion 211. As shown in the B-B cross-section, since the bi-metal 212 is deformed in the arched shape, and the tip of the arm 214A is installed on the bi-metal 212, due to the deformation of the bi-metal 212, the arm 214B attempts to rotate in a direction away from the side surface of the heat source 50 (the Q direction) with the point of support 214X as the center. That is, since the force that is generated as a result of the deformation of the bi-metal 212 (the force for sliding the heat source 50 in the upper direction and the force for moving the arm 214B away in the Q direction) is more than the biasing force in the direction close to the side surface of the heat source 50 (the P direction), the locked state in which the tip of the arm 214B of the holding spring 214 is engaged in the groove portion 52 of the heat source 50 is unlocked. Here, from the viewpoint of simplifying the unlocking of the locked state, it is preferable to install the tip of the arm 214A on the part of the bi-metal 212 having the highest amount of deformation (for example, the apex part of the arch shown in the A-A cross-section of FIG. 9). Moreover, the locked state may be unlocked only by the force of rotating the arm 214B in the direction away from the side surface of the heat source 50 (the Q direction) with the point of support 214X as the center.

Note that in the B-B cross-section of FIG. 9, although the tip of the arm 214B is separated from the side surface of the heat source 50, the tip of the arm 214B may be brought in contact with the side surface of the heat source 50 by the biasing force provided in the arm 214B. As described above, since the tip of the arm 214B has a circular shape in the B-B cross-section, it must be noted that even though the tip of the arm 214B slides across the side surface of the heat source 50, the side surface of the heat source 50, including the groove portion 52, is not damaged easily.

Moreover, in order to appropriately unlock the locked state, the amount of deformation of the bi-metal 212 is decided in accordance with the length of insertion of the tip of the arm 214B in the groove portion 52, and the shape of the holding spring 214. That is, in the first embodiment, the amount of deformation of the bi-metal 212 is decided on the basis of the length of insertion of the tip of the arm 214B in the groove portion 52, the length of the arm 214A, the length of the arm 214B, and the angle formed by the arm 214A and the arm 214B. However, the shape of the holding spring 214 is not restricted to the V-shape formed by the two arms, and could even be a U-shape formed by three arms.

As shown in FIG. 10, as a result of stopping of heating of the heat source 50 by the heating portion 211, the temperature of the heat source 50 falls below the predetermined temperature (that is, the fusion point of the latent heat storage material), and the bi-metal 212 deforms from the arched shape to the flat plate shape. As shown in the A-A cross-section, since the bi-metal 212 is deformed in the flat plate shape, the contact point 213B comes in contact with the contact point 213A. As described above, if the bi-metal 212 is deformed in the arched shape, then by stopping the supply of the electric power of the battery 240 to the heating portion 211 by the circuit board 230, the unnecessary reheating of the heat source 50 is controlled. As shown in the B-B cross-section, the bi-metal 212 is deformed in the flat plate shape. In such a case, it is preferable that the heat source 50 that is stored in the storage portion 210 is held on the inner wall surface 210B of the storage portion 210 by the biasing force provided in the arm 214B (that is, the biasing force in the direction close to the side surface of the heat source 50 (the P direction)), when slided in the upward direction. Here, the force of holding the heat source 50 on the inner wall surface 210B of the storage portion 210 in the unlocked state (the state of sliding in the upward direction) is preferably lesser than the force of pushing up the heat source 50 as a result of the deformation of the bi-metal 212, and more than the force of dropping of the heat source 50 due to the dead weight of the heat source 50. It is possible to realize the above-described configuration, for example, by appropriately adjusting the spring strength (the biasing force described above) of the holding spring 214 in an unlocked state. Thus, it is possible to easily take out the heat source 50 from the storage portion 210 in the state where the heat source 50 has been inserted in the holding member 30.

Moreover, the tip of the arm 214B may be configured by a member that has a higher coefficient of friction as compared to the other parts of the arm 214B (for example, rubber). Alternatively, the tip of the arm 214B may be covered by a member that has a higher coefficient of friction as compared to the other parts of the arm 214B (for example, rubber). Thus, even if the spring strength (the biasing force described above) of the holding spring 214 is weak, it is possible to hold the heat source 50 on the inner wall surface 210B of the storage portion 210 in an unlocked state (the state of sliding in the upward direction). In addition, if the tip of the arm 214B is configured by a soft member, alternatively, if the tip of the arm 214B is covered by a soft member, such as rubber, it must be noted that the side surface of the heat source 50 is not damaged easily.

(Operation and Effect)

In the first embodiment, since the heat source 50 provided separately from the holding member 30 includes the sugar alcohol as the latent heat storage material, as compared to the latent heat storage material such as sodium acetate, almost no smell is generated even after it is heated up to the fusion point, and therefore, it is possible to improve the flavor without losing the flavor.

In the first embodiment, since the latent heat storage material is the sugar alcohol having the carbon number of four or more, it is possible to obtain a comparatively high latent heat. Therefore, it is possible to transmit a comparatively high temperature from the heat source 50 to the flavor source.

In the first embodiment, the heat source 50 is configured by the mixture of the latent heat storage material and the retaining material. Therefore, as compared to a case where an air-tight container having heat resistance and pressure resistance is used for storing the latent heat storage material, it is possible to reduce the weight of the heat source 50, and it is possible to make the heat source 50 smaller in size.

In the first embodiment, the locking mechanism (the bi-metal 212 and the holding spring 214) unlocks the locked state of the heat source 50 when the temperature of the heat source 50 exceeds the predetermined temperature. Therefore, it is possible to control the disengagement of the heat source 50 during heating of the heat source 50, and at the same time, it is possible to easily take out the heat source 50 after the heating of the heat source 50 is complete.

In the first embodiment, the heating portion 211 stops heating the heat source 50 when the temperature of the heat source 50 exceeds the predetermined temperature. Therefore, in a case when the heat source 50 includes a latent heat storage material, it is possible to prevent the super-cooling phenomenon of the latent heat storage material.

In the first embodiment, the bi-metal 212 is arranged to be in direct contact with the heat source 50, and the locking state of the heat source 50 is unlocked due to the deformation of the bi-metal 212. Therefore, the locked state of the heat source 50 is unlocked at an appropriate timing.

In the first embodiment, the bi-metal 212 is arranged to be in direct contact with the heat source 50, and the heating of the heat source 50 is stopped due to the deformation of the bi-metal 212. Therefore, it is possible to stop the heating of the heat source 50 at an appropriate timing when the super-cooling phenomenon of the latent heat storage material does not occur.

In the first embodiment, the bi-metal 212 is arranged to be in direct contact with the heat source 50, and the heat source 50 slides due to the deformation of the bi-metal 212. Therefore, after the heating of the heat source 50, the heat source 50 is installed easily on the holding member 30.

[First Modification]

Hereinafter, a first modification of the first embodiment will be described. Mainly differences from the first embodiment are described below.

Figure 11:
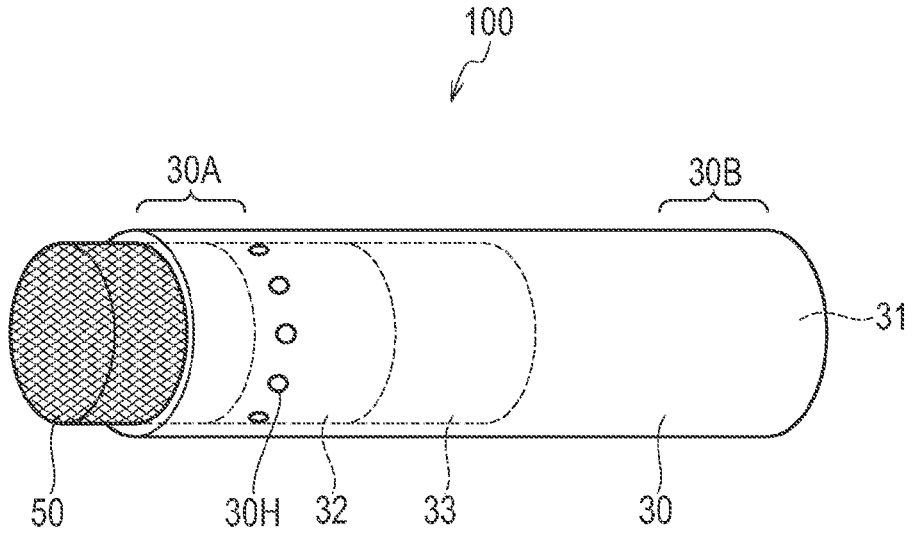
FIG. 11 is a drawing showing a holding member 30 according to a first modification.

In the first modification, as shown in FIG. 11, the holding member 30 has a side hole 30H that leads to the cavity 31. The side hole 30H extends from the support end 30A along a direction that crosses the direction facing the mouthpiece-side end 30B. The side hole 30H is preferably provided on the support end 30A, and adjoining the flavor source 32.

Moreover, in addition to the flavor source 32, the holding member 30 has a rectification member 33. The flavor source 32, for example, may be realized by laminating a member having air permeability, such as a nonwoven cloth and granular tobacco leaves to form the flavor source 32 in the shape of a sheet through thermal fusion bonding, which is then arranged in a disk shape (thin columnar shape). The rectification member 33 is provided at the side of the mouthpiece-side end 30B with respect to the flavor source 32. The rectification member 33 has a through hole that extends from the support end 30A along the direction facing the mouthpiece-side end 30B. The rectification member 33 is formed by a member that does not have air permeability.

Figure 12:
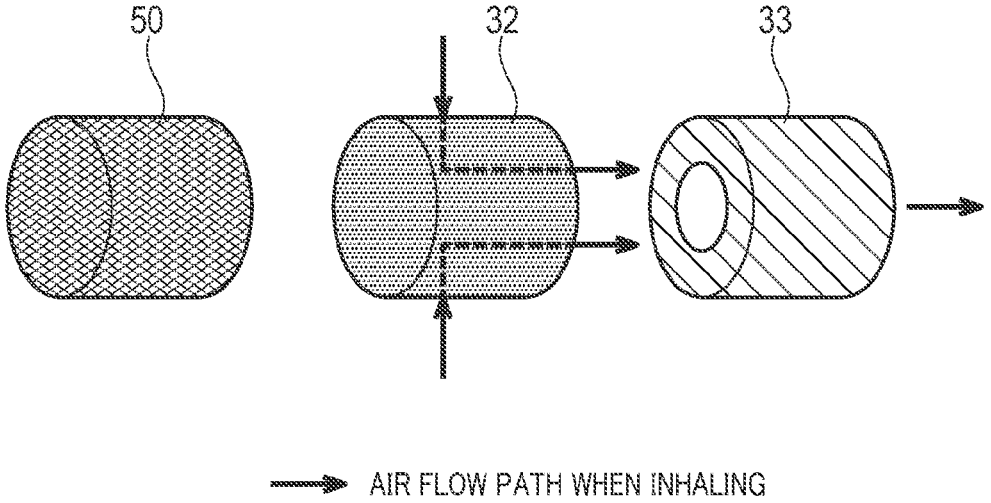
FIG. 12 is a drawing for explaining an air flow path according to the first modification.

When a user inhales the flavor, the air that is taken in from the side hole 30H is led to the side of the mouthpiece-side end 30B through the flavor source 32, as shown in FIG. 12. The air that is led to the side of the mouthpiece-side end 30B through the flavor source 32 is led to the mouthpiece-side end 30B through the through hole of the rectification member 33. Therefore, when a user inhales the flavor, even if the heat source 50 does not have a configuration that includes air permeability, such as having a through-hole leading to the mouthpiece-side end 30B, for example, it is possible to form an air flow that passes through the flavor source 32 and is led to the mouthpiece-side end 30B, which makes it possible to effectively heat the entire surface of the flavor source 32 that is in contact with the heat source 50. Moreover, since a rectification member 33 that is formed by a member that does not have air permeability is provided, when a user inhales the flavor, the flow of the air is controlled by the rectification member 33 so as to pass through the center part inside the flavor source 32, thus making it possible to add a sufficient flavor to the air passing through the flavor source 32.

[Second Modification]

Hereinafter, a second modification of the first embodiment will be described. Mainly differences from the first embodiment are described below.

Figure 13:
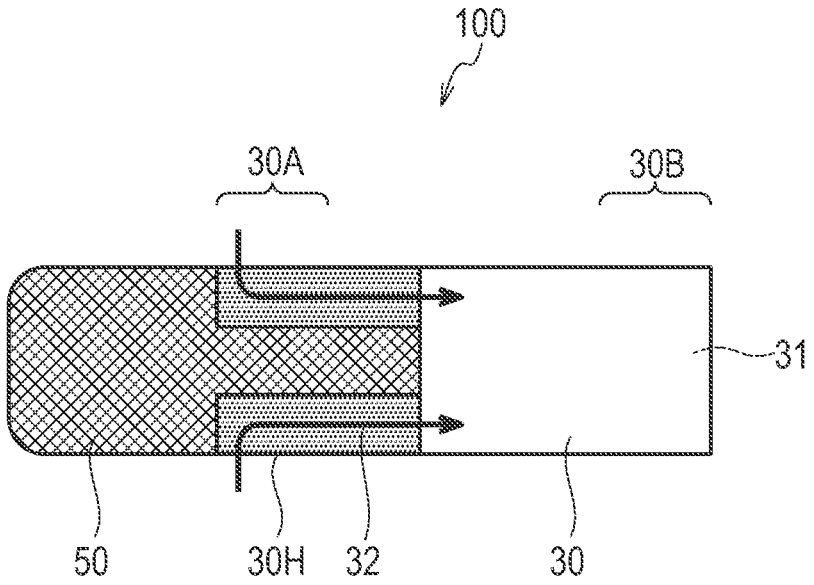
FIG. 13 is a drawing showing a holding member 30 according to a second modification.

In the second modification, as shown in FIG. 13, the holding member 30 has a side hole 30H that leads to the cavity 31. The configuration of the side hole 30H is the same as in the first modification.

In the second modification, the flavor source 32 may be realized by laminating a member having air permeability, such as a nonwoven cloth and granular tobacco leaves to form the flavor source 32 in the shape of a sheet through thermal fusion bonding, which is then arranged in a cylindrical shape having an opening in the center for inserting the heat source 50. Moreover, the flavor source 32 may be a cylindrical body formed through extrusion that has an opening in the axial direction and air permeability inside.

When a user inhales the flavor, the air that is taken in from the side hole 3011 is led to the side of the mouthpiece-side end 30B through the flavor source 32, as shown in FIG. 13. Therefore, when a user inhales the flavor, even if the heat source 50 does not have a configuration that includes air permeability, such as having a through-hole leading to the mouthpiece-side end 30B, for example, it is possible to form an air flow that passes through the flavor source 32 and is led to the mouthpiece-side end 30B. Moreover, as shown in FIG. 13, since the area of the flavor source 32 that is contact with the heat source 50 is large, it is possible to effectively perform the heating.

[Third Modification]

Hereinafter, a second modification of the first embodiment will be described. Mainly differences from the first embodiment are described below.

In the first embodiment, the tip of the arm 214A is mounted on the bi-metal 212, and the arm 214B has a biasing force in a direction close to the side surface of the heat source 50 (the P direction), with the point of support 214X as the center.

In contrast, in the third modification, the tip of the arm 214A is arranged on the lower side of the bi-metal 212, and the arm 214B does not particularly have a biasing force. However, the arm 214B may have a slight biasing force in a direction that is close to the side surface of the heat source 50 (the P direction), with the point of support 214X as the center.

Firstly, as shown in FIG. 8 described above, in the state where the heat source 50 is stored in the storage portion 210, the bi-metal 212 has the flat plate shape. In such a state, the tip of the arm 214A is held by the bi-metal 212, and therefore, the holding spring 214 rotates in a direction that is close to the side surface of the heat source 50 (the P direction), and the tip of the arm 214B is engaged in the groove portion 52 of the heat source 50. Thus, the heat source 50 is locked within the storage portion 210. In such a state, the angle formed by the arm 214A and the arm 214B is specified such that the tip of the arm 214B is engaged in the groove portion 52 of the heat source 50.

Secondly, as shown in FIG. 9 described above, if the heat source 50 is heated by the heating portion 211, and the temperature of the heat source 50 exceeds the predetermined temperature (that is, the fusion point of the latent heat storage material), the bi-metal 212 deforms from the flat plate shape to the arched shape. In such a case, the tip of the arm 214A is capable of moving freely in the space created as a result of the deformation of the bimetal 212. In other words, since the regulation on the holding spring 214 is released as a result of the deformation of the bi-metal 212, the holding spring 214 is capable of rotating in a direction away from the side surface of the heat source 50 (the Q direction). That is, the heat source 50 slides in a direction along the inner wall surface 210B of the storage portion 210 as a result of the deformation of the bi-metal 212, and the state in which the tip of the arm 214B is engaged in the groove portion 52 of the heat source 50 is released.

Thirdly, as shown in FIG. 10 described above, as a result of stopping of heating of the heat source 50 by the heating portion 211, the temperature of the heat source 50 falls below the predetermined temperature (that is, the fusion point of the latent heat storage material), because of which the bi-metal 212 deforms from the arched shape to the flat plate shape.

Here, in the third modification, since the arm 214B does not have the biasing force in the P direction, the tip of the arm 214B is probably not in contact with the side surface of the heat source 50, and therefore, the heat source 50 is not held by the tip of the arm 214B. However, in the third modification, the heat source 50 is held by the storage portion 210 as a result of the frictional force between the side surface of the heat source 50 and the inner wall surface 210B of the storage portion 210. The frictional force between the side surface of the heat source 50 and the inner wall surface 210B of the storage portion 210 is preferably lesser than the force of pushing up the heat source 50 due to the deformation of the bi-metal 212, and more than the force of dropping of the heat source 50 due to the dead weight of the heat source 50.

EXAMPLES

Hereinafter, the present invention will be described in more detail using examples. It is needless to say that the present invention is not restricted to the examples described below.

Example 1

A predetermined amount of mannitol (latent heat storage material), vermiculite (retaining material for the latent heat storage material), hydroxypropyl cellulose, and water was mixed, the compound thus obtained was made to undergo tablet reduction to obtain a formed body in the shape of a pellet. By drying the compound thus obtained, the heat source described in example 1 was obtained. The composition of the heat source thus obtained is described below. Note that the heat source according to example 1 has a circular cylindrical shape with a diameter of 10 mm, and the weight percentage of mannitol and vermiculite is 1:1.

TABLE 1

| | Mannitol (mg) | Vermiculite (mg) | Hydroxypropyl cellulose (mg) |
|---|---|---|---|
| Example 1 | 405.7 | 405.7 | 67.6 |

(Measurement of Time-Dependent Changes During Heating of Heat Source)

Figure 14:
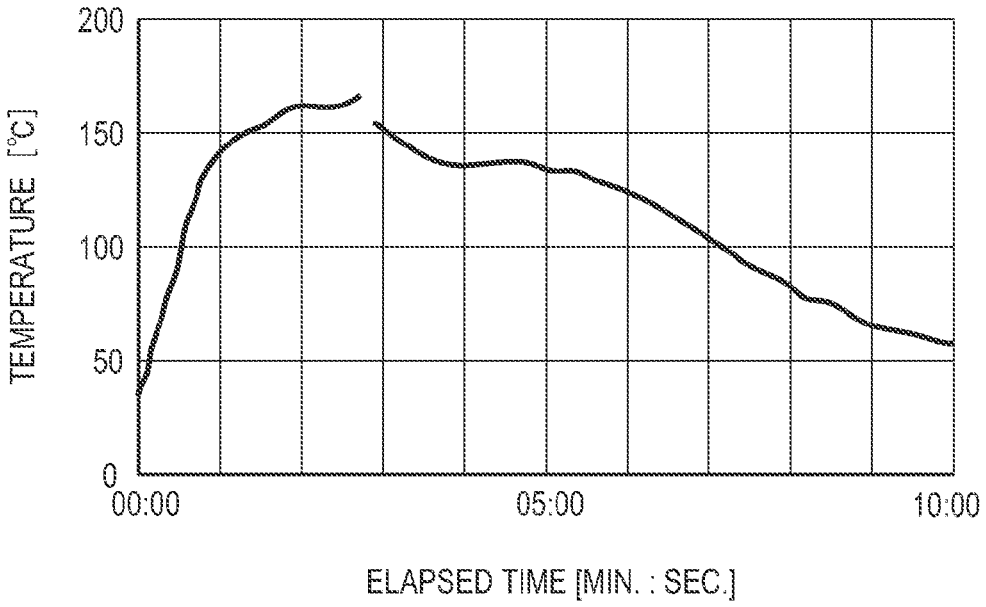
FIG. 14 is a drawing showing the experiment result (example 1).

The sample according to example 1 was wrapped in aluminum foil, which was then heated on a hotplate at 250° C. until the latent heat storage material dissolved, and then removed from the hotplate and left at rest. By bringing a thermocouple in contact with the top surface of the sample directly after starting heating on the hotplate, the time-dependent changes of the temperature in the heat source were measured. The profile thus obtained is shown in FIG. 14. Note that in order to remove the sample from the hotplate, the thermocouple is separated temporarily (the discontinuous part in FIG. 14).

Example 2

Figure 15:
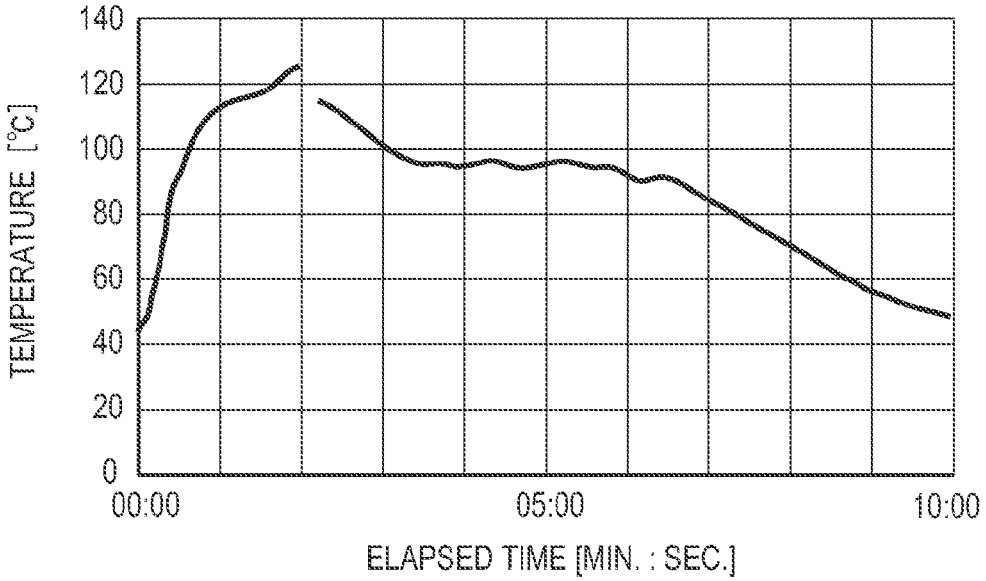
FIG. 15 is a drawing showing the experiment result (example 2).

The heat source was obtained by using the same method as that in example 1 except for using erythritol in place of mannitol and changing the mixing amount of each material to obtain pellets of 8-mm diameter. The composition of the heat source thus obtained is described below. Note that the heat source according to example 2 has a circular cylindrical shape with a diameter of 8 mm, and the weight percentage of erythritol and vermiculite is 1:1. Moreover, the time-dependent changes of the temperature in the heat source were measured using the same method as the method according to example 1. The profile thus obtained is shown in FIG. 15.

TABLE 2

| | Erythritol (mg) | Vermiculite (mg) | Hydroxypropyl cellulose (mg) |
|---|---|---|---|
| Example 2 | 307.4 | 307.4 | 51.2 |

Example 3

Figure 16:
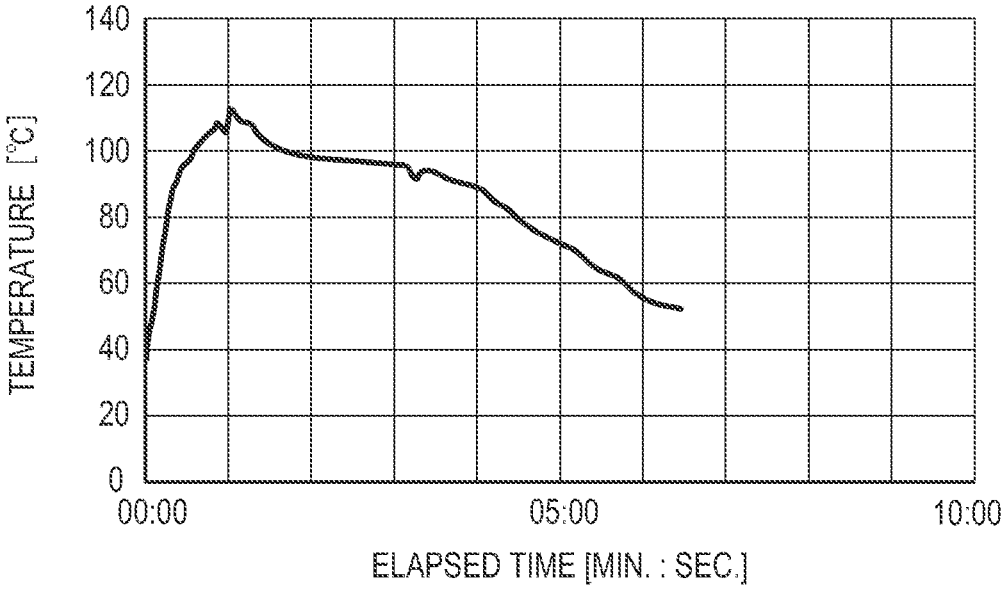
FIG. 16 is a drawing showing the experiment result (example 3).
Figure 17:
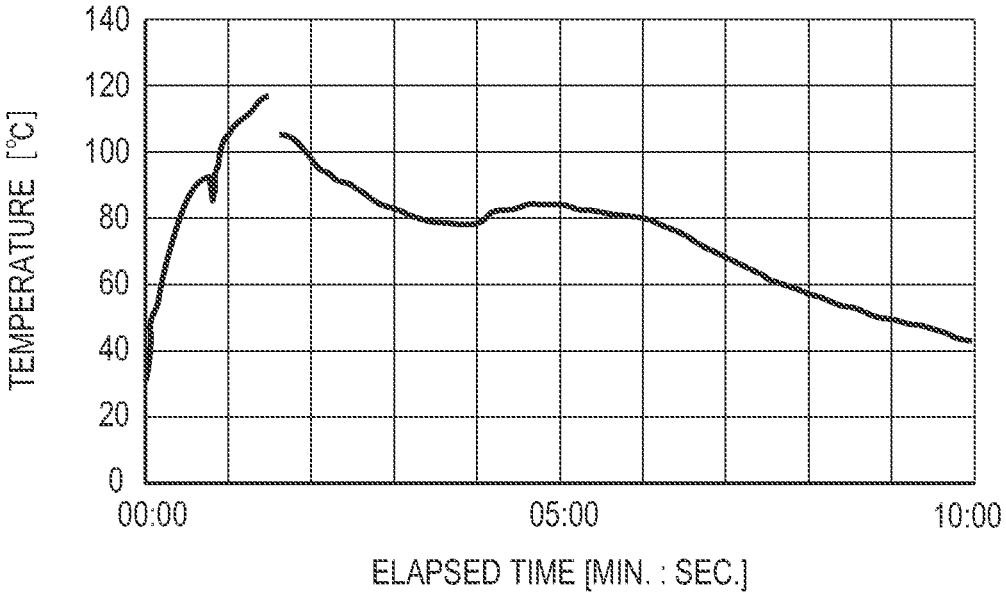
FIG. 17 is a drawing showing the experiment result (example 4).

A heat source having the composition shown below was obtained by using the same method as that in example 2 except for mixing each raw material under the same mixing conditions as example 2, and then appropriately adjusting the conditions for tableting. Note that the heat source according to example 3 has a circular cylindrical shape with a diameter of 8 mm, and the weight percentage of erythritol and vermiculite is 1:1. Moreover, the time-dependent changes of the temperature in the heat source were measured using the same method as the method according to example 1. The profile thus obtained is shown in FIG. 16.

TABLE 3

| | Erythritol (mg) | Vermiculite (mg) | Hydroxypropyl cellulose (mg) |
|---|---|---|---|
| Example 3 | 204.2 | 204.2 | 34.0 |

Example 4

A predetermined amount of erythritol, activated carbon, hydroxypropyl cellulose, and water was mixed, the compound thus obtained was made to undergo tableting to obtain a formed body in the shape of a pellet. By drying the compound thus obtained, the heat source described in example 4 was obtained. The composition of the heat source thus obtained is described below. Note that the heat source according to example 4 has a circular cylindrical shape with a diameter of 10 mm, and the weight percentage of erythritol and activated carbon is 3:1.

TABLE 4

| | Erythritol (mg) | Activated carbon (mg) | Hydroxypropyl cellulose (mg) |
|---|---|---|---|
| Example 4 | 403.8 | 134.6 | 38.1 |

As clear from FIG. 15 (example 2) as well as FIG. 16, even if the weight percentage of the latent heat storage material and the holding member is the same (1:1), when the content of the latent heat storage material is 300 mg, it is possible to increase the time duration for which the temperature of the latent heat storage material is maintained as compared to a case where the content of the latent heat storage material is 200 mg.

In the form of another information, the inventors of the present invention discovered that if the heating temperature of the flavor source is 90 degrees or more, and if tobacco leaves are used as the flavor source, it is possible to effectively volatilize the flavor components in the tobacco leaves. If the result shown in FIG. 14 and FIG. 15 is taken into consideration in addition to the above information, it is understood that erhythritol is a better latent heat storage material than mannitol. Specifically, in FIG. 15 (example 2), the temperature range when the heating temperature reaches 90 degrees or more and then again falls below 90 degrees, is narrower as compared to FIG. 14 (example 1). Therefore, it is known that it is possible to supply a stable amount of heat to the flavor source, as compared to mannitol.

Other Embodiments

The present invention is explained through the above-described embodiments, but it must not be understood that this invention is limited by the statements and the drawings constituting a part of this disclosure. From this disclosure, various alternative embodiments, examples, and operational technologies will become apparent to those skilled in the art.

In the embodiments, only a non-burning type flavor inhaler 100 is illustrated as an example of the non-burning type flavor inhaler. The configuration of the non-burning type flavor inhaler is not limited to the above-described embodiments, and the non-burning type flavor inhaler may include the above-described heat source 50.

In the embodiments, a case where the heat source 50 is configured by a mixture of a latent heat storage material and a retaining material is illustrated. However, the embodiment is not limited thereto. For example, the heat source 50 may be configured by a latent heat storage material, and an airtight container having heat resistance and pressure resistance, which stores the latent heat storage material.

In the embodiments, a case where the non-burning type flavor inhaler 100 has a cylindrical shape is illustrated. However, the embodiment is not limited thereto. For example, the non-burning type flavor inhaler 100 may have a solid circular cylindrical shape. Alternatively, the non-burning type flavor inhaler 100 may have the flat plate shape.

In the embodiments, the holding member 30 has a cylindrical shape. However, the embodiment is not limited thereto. The holding member 30 may suffice to be configured to allowing the heat source 50 to be detachably held.

In the embodiments, a case where vermiculite is used as the retaining material configuring the heat source 50 is illustrated. However, the embodiment is not limited thereto. For example, activated carbon may be used as the retaining material configuring the heat source 50.

In the embodiments, the heating apparatus 200 is driven by the electric power accumulated in the battery 240. However, the embodiment is not limited thereto. For example, the heating apparatus 200 may be driven by the electric power supplied from an AC power source.

In the embodiments, the bi-metal 212 is configured to be deformed between the flat plate shape and the arched shape, with a predetermined temperature (that is, the fusion point of the latent heat storage material) as the limit. The deformation of the bi-plate 212 is not limited to such deformations.

In the embodiments, the side wall of the heat source 50 is held by the holding spring 214 in response to the insertion of the heat source 50 in the storage portion 210. However, other configurations may be adopted as the holding member that holds the side wall of the heat source 50 in response to the insertion of the heat source 50 in the storage portion 210. In such a case, the holding member is preferably configured to unlock the locked state of the heat source 50 as a result of the deformation of the bi-metal 212.

In the embodiments, the locking mechanism is configured by a bi-metal 212 and a holding spring 214. However, other mechanisms may be adopted as the locking mechanism. For example, the locking mechanism may be configured to have a sensor such that when the sensor detects that the temperature of the heat source 50 has reached a predetermined temperature, the locking mechanism unlocks the locked state of the heat source 50.

In the embodiments, the sliding mechanism is configured by a bi-metal 212. However, other mechanisms may be adopted as the sliding mechanism. For example, the sliding mechanism may be configured to have a sensor such that when the sensor detects that the temperature of the heat source 50 has reached a predetermined temperature, the sliding mechanism slides the heat source 50 along an inner wall surface 210B of the storage portion 210.

In the embodiments, the heat source 50 is inserted in the storage portion 210 along the vertical direction. However, the embodiment is not limited thereto. The heat source 50 may be inserted in the storage portion 210 along the horizontal direction.

In the embodiments, the bi-metal configuring the locking mechanism and the bi-metal configuring the sliding mechanism is the same member (the bi-metal 212). However, the embodiment is not limited thereto. The bi-metal configuring the locking mechanism and the bi-metal configuring the sliding mechanism may be different members.

In the embodiments, the heating apparatus 200 heats the heat source 50 including a mixture of a latent heat storage material and a retaining material. However, the embodiment is not limited thereto. If the non-burning type flavor inhaler has a cylindrical holding member and a heat source that is provided so that at least a part thereof is protruding out from the holding member, it is possible to favorably apply the heating apparatus 200 regardless of the type of the heat source, for example, the heat source may be a carbon heat source or a tobacco formed body. Note that it is obvious that regardless of the type of the heat source, as described above, it is preferable to provide a groove portion for engaging the holding spring 214 of the heating apparatus 200 in the heat source.

In addition, the entire content of Japanese Patent Application No. 2013-47285 (filed on Mar. 8, 2013) and Japanese Patent Application No. 2013-47286 (filed on Mar. 8, 2013) are incorporated in the present specification by references.

INDUSTRIAL APPLICABILITY

According to the present invention, it is possible to provide a non-burning type flavor inhaler that can improve the flavor.

The invention claimed is:

1. A non-burning type flavor inhaler, comprising:

a heat source that supplies heat energy to a flavor source; and a holding member that detachably holds the heat source, wherein the heat source has a latent heat storage material including a sugar alcohol having a carbon number of four or more and the heat source includes a mixture of the latent heat storage material, a binder and a retaining material that retains the latent heat storage material.

2. The non-burning type flavor inhaler according to claim 1, wherein a content of the latent heat storage material is 300 mg or more, and 600 mg or less.

3. The non-burning type flavor inhaler according to claim 1, wherein the retaining material is vermiculite.

4. The non-burning type flavor inhaler according to claim 3, wherein a content of vermiculite is 100 wt % or more and 200 wt % or less with respect to the latent heat storage material.

5. The non-burning type flavor inhaler according to claim 1, wherein the binder includes a hydroxypropyl cellulose.

6. The non-burning type flavor inhaler according to claim 1, wherein the heat source is configured by a tableting or extrusion process.

7. The non-burning type flavor inhaler according to claim 1, wherein the latent heat storage material is erythritol.

8. A system comprising:

a non-burning type flavor inhaler; and a heating apparatus, wherein the non-burning type flavor inhaler comprises:

a heat source that supplies heat energy to a flavor source; and a holding member that detachably holds the heat source, the heating apparatus comprises:

a storage portion that stores the heat source; and a heating portion that heats the heat source, wherein the heat source has a latent heat storage material including a sugar alcohol having a carbon number of four or more, and the heat source includes a mixture of the latent heat storage material, a binder and a retaining material that retains the latent heat storage material.

9. The system according to claim 8, wherein the storage portion includes a bi-metal that deforms as a temperature of the heat source reaches a predetermined temperature.

10. The system according to claim 8, wherein the heating portion is an electrically-heated wire.

* * * * *